US007757775B2

(12) United States Patent
Hammami et al.

(10) Patent No.: US 7,757,775 B2
(45) Date of Patent: Jul. 20, 2010

(54) MITIGATION OF LOCALIZED STRESS IN TUBULARS

(75) Inventors: Ahmed Hammami, Edmonton (CA); Scott Jacobs, Edmonton (CA); Bernadette Craster, Edmonton (CA); Todd Yakimoski, Beaumont (CA); J.R. Anthony Pearson, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 266 days.

(21) Appl. No.: 11/864,328

(22) Filed: Sep. 28, 2007

(65) Prior Publication Data

US 2008/0164037 A1 Jul. 10, 2008

Related U.S. Application Data

(60) Provisional application No. 60/884,075, filed on Jan. 9, 2007.

(51) Int. Cl.
*E21B 17/00* (2006.01)

(52) U.S. Cl. ..... 166/380; 166/384

(58) Field of Classification Search ..... 166/380, 166/382, 212, 384, 207; 138/137, 140
See application file for complete search history.

(56) References Cited

U.S. PATENT DOCUMENTS

| | | | | |
|---|---|---|---|---|
| 5,056,598 | A | 10/1991 | Jennings, Jr. | |
| 5,937,955 | A * | 8/1999 | Nims et al. | 175/61 |
| 5,944,099 | A * | 8/1999 | Sas-Jaworsky | 166/77.2 |
| 6,703,095 | B2 * | 3/2004 | Busshoff et al. | 428/36.91 |
| 6,863,130 | B2 * | 3/2005 | Steele et al. | 166/380 |
| 7,033,975 | B2 * | 4/2006 | Baran et al. | 507/102 |
| 2004/0089449 | A1 * | 5/2004 | Walton et al. | 166/297 |
| 2005/0017723 | A1 * | 1/2005 | Entov et al. | 324/346 |
| 2005/0230124 | A1 * | 10/2005 | Cook et al. | 166/384 |

FOREIGN PATENT DOCUMENTS

EP 476814 A1 3/1992

OTHER PUBLICATIONS

Busser, G.C., "Selection Criteria on Oilfield Tubulars"; 7th NACE International Middle East Corrosion Conf. Proceeding V1, pp. 418 to 428, Manama, Bahrain, Feb. 26-28, 1996.

Dusseault, M.B. et al., "Casing Shear: Causes, Cases, Cures"; SPE Drilling & Completion, pp. 98-107, Jun. 2001, SPE 72060.

(Continued)

*Primary Examiner*—Hoang Dang
*Assistant Examiner*—Brad Harcourt
(74) *Attorney, Agent, or Firm*—Robert A. Van Someren; Wayne I. Kanak

(57) ABSTRACT

A technique distributes localized stress acting on a tubular. The tubular is formed with an inner layer and an outer layer that is compliant relative to the inner layer. A force distribution material is disposed between the inner layer and the outer layer to spread any concentrated loads acting against the tubular. The compliant nature of the outer layer causes it to distort against the force distribution material when acted on by a concentrated external load. The outer compliant layer and the force distribution material cooperate to isolate and protect the inner layer from displacements of the surrounding subterranean material.

17 Claims, 3 Drawing Sheets

OTHER PUBLICATIONS

Evans, G.W. and Harriman, D.W.: "Laboratory Test on Collapse Resistance of Cemented Casing", Proceedings of 47th Annual Fall Meeting of the Society of Petroleum Engineers of AIME, San Antonio, Texas, Oct. 8-11, 1972.

Fredrich, J.T. et al., "Three-Dimensional Geomechanical Simulation of Reservoir Compaction and Implications for Well Failures in the Belridge Diatomite", 1996 SPE Annual Technical Conference and Exhibition, Denver, Colorado, Oct. 6-9, 1996, SPE 36698.

He, L. et al., "Challenges and Countermeasures Facing Casing Damage in Daqing Oilfield", 2005 SPE Europe/EAGE Annual Conference, Madrid, Spain, Jun. 13-16, 2005, SPE 92292.

Hilbert, L.B. Jr. et al., "Field-Scale and Wellbore Modeling of Compaction-Induced Casing Failures", SPE Drilling & Completion 14(2), pp. 92-1001, Jun. 1999.

Ravi, K. et al., "A Comparative Study of Mechanical Properties of Density-Reduced Cement Compositions", SPE 90068, 2004.

* cited by examiner

MITIGATION OF LOCALIZED STRESS IN TUBULARS

CROSS-REFERENCE TO RELATED APPLICATIONS

This application claims priority to U.S. Provisional Application No. 60/884,075, filed Jan. 9, 2007. This application is related to U.S. Provisional Application No. 60/884,067, also filed Jan. 9, 2007, and to the regular patent application filed of even date herewith claiming priority therefrom.

BACKGROUND OF THE INVENTION

In many downhole applications, stress concentrations or stress dipoles can develop due to zonal slip, reservoir compaction, placement of gravel pack packers, liner overlap, cement voids, and other environmental factors. The stress concentration can create ovalization and shear failures in tubular components, e.g. well casing, drill pipe, and production tubing used in the well environment. In some reservoirs and overburden rock, zonal slip and/or movements of the rock or formation can occur as a result of production processes or mild seismic events. The transverse shifting of subterranean material can induce the localized stress concentrations that lead to shear failure.

In other well-related environments, reservoir compaction can cause casing failures through tension, buckling, collapse, and shearing. The shearing failure mechanism can occur as localized deformation of casing over very small lengths. For example, wellbores drilled through layers of subsurface shale can be subjected to horizontal shifting of the subsurface shale when the corresponding reservoirs undergo a few feet of vertical compaction/subsidence. The casing shear failure usually is caused by displacement of the rock strata along bedding planes or along more steeply inclined fault planes. Casing deformation mechanisms include localized horizontal shear at weak lithology interfaces within the overburden, localized horizontal shear at the top of production and injection intervals, and casing buckling within the producing interval near, for example, perforations through the casing. These types of failures are expensive and can impede or even interrupt operation of the well.

BRIEF SUMMARY OF THE INVENTION

In general, the present invention provides a method and system for distributing localized stress that can act on a tubular. A tubular resistant to localized stress is formed with an inner layer and an outer layer disposed radially outwardly of the inner layer. A force distribution material is disposed between the inner layer and the outer layer to spread any concentrated loads acting against the tubular. The outer layer is a compliant layer that acts against the force distribution material when distorted by a concentrated external load. The outer compliant layer and the force distribution material cooperate to isolate and protect the inner layer from transverse and longitudinal displacements and can accommodate longitudinal displacement of the inner layer.

BRIEF DESCRIPTION OF THE DRAWINGS

Certain embodiments of the invention will hereafter be described with reference to the accompanying drawings, wherein like reference numerals denote like elements, and.

DETAILED DESCRIPTION OF THE INVENTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a methodology and system for mitigating localized stress in tubulars. A tubular member, such as a well casing, drill string, gravel pack packer, buried pipeline, or other subsurface installation, utilizes force distribution elements that are able to spread/redistribute concentrated loads acting against the tubular member. The force distribution elements of an outer layer are designed to independently comply and deform tinder concentrated loads to isolate and protect an inner cylindrical form from the concentrated loading. The methodology and system are particularly amenable to use in environments subject to shear loads but also provide protection against longitudinal displacements. In a well application, for example, the potential for collapse and/or buckling of a tubular due to subsidence is reduced, and the potential for damage due to shear loads is also reduced.

The methodology and system for mitigating the effects of localized loading is particularly useful in a variety of well environments. Protection is provided against zonal slip, formation movements, shifting of subsurface shale layers, and other subterranean rock movements encountered in reservoirs and overburden. However, the unique approach described herein can be used with tubular devices employed in a variety of applications and environments, including buried pipelines and other tubular subsurface installations.

Figure 1:
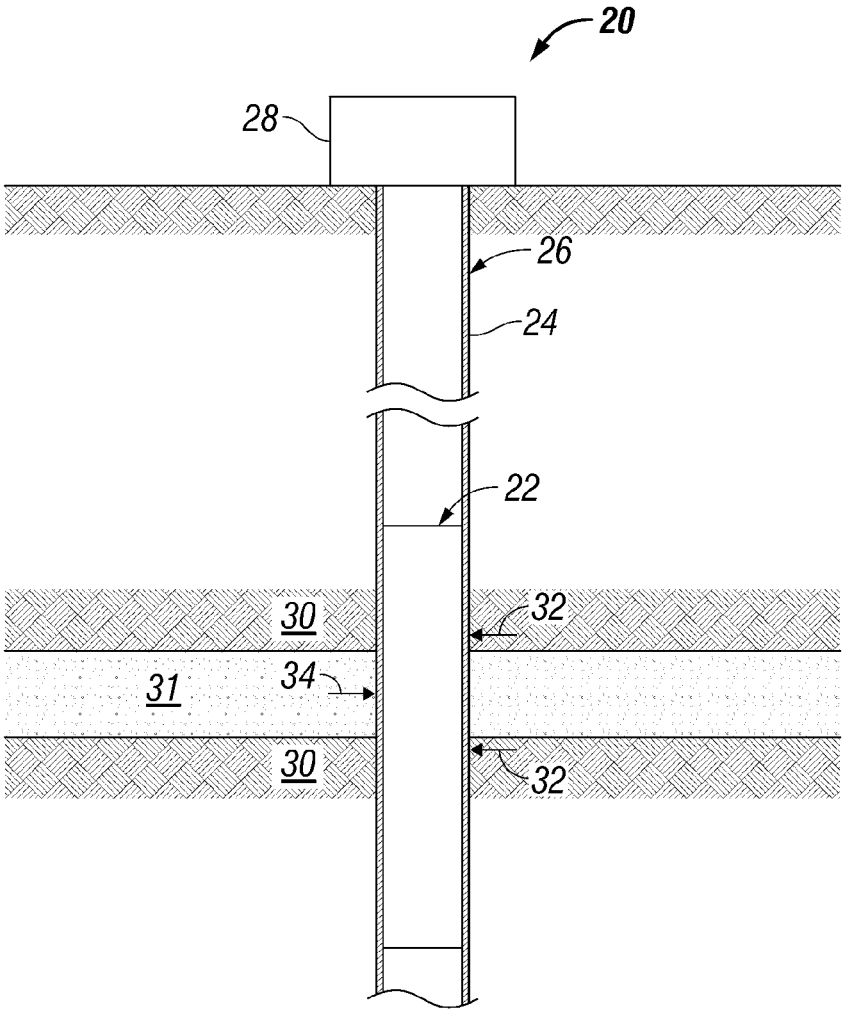
FIG. 1 is a front elevation view of a tubular member deployed in a subterranean environment and subjected to localized loading, according to an embodiment of the present invention.

Referring generally to FIG. 1, one embodiment of a system 20 is illustrated as deployed in a subterranean environment with a tubular member 22 which is constructed according to an embodiment of the present invention. In this embodiment, tubular member 22 is deployed in a wellbore 24 and forms part of a well string 26 positioned in wellbore 24 beneath a wellhead 28. The wellbore 24 is drilled into a subsurface region 30 that may comprise overburden, one or more formations, production fluid, and other geological features. The type of tubular member 22 utilized will vary from one application to another. The illustrated tubular member 22 is representative of, for example, a casing, a drill string section, a gravel pack packer, an underground pipeline section, or other tubular member that is potentially subject to concentrated loading.

The tubular member 22 is designed to spread, i.e. redistribute, concentrated load forces acting against the tubular member, as represented by arrows 32 and 34. In the illustrated example, arrow 34 represents a force acting 19 an opposite direction of the forces represented by arrows 32. These opposing forces, caused by relative displacement of the subsurface regions 30 and 31, create a shear load acting against tubular member 22. In conventional tubular structures, such shear loads can damage or destroy the functionality of the tubular structure. However, through the use of a compliant outer layer that reduces the severity of shear loads on the inner tubular, tubular member 22 is able to spread these highly localized loads along the tubular member so as to preserve the functionality of system 20.

Figure 2:
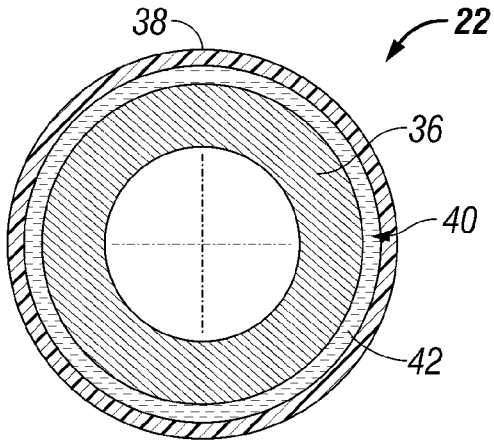
FIG. 2 is a cross-sectional view of an embodiment of a tubular member, according to an embodiment of the present invention.

Referring generally to FIG. 2, a cross-sectional view of an embodiment of tubular member 22 is illustrated. In this embodiment, tubular member 22 comprises an inner layer 36 and an outer layer 38 disposed radially outward of inner layer 36. Outer layer 38 is a compliant layer, i.e. a low modulus layer, relative to inner layer 36. The compliancy of outer layer 38 provides substantial flexibility under concentrated loading. By way of example, inner layer 36 may comprise a steel material and outer layer 38 may comprise a polymeric material.

A force distribution material 40 is deployed radially between inner layer 36 and outer layer 38. Force distribution material 40 is a compressible material which works in cooperation with compliant outer layer 38 to redistribute localized loading along tubular member 22. The spreading of the force isolates and protects inner layer 36 from the concentrated loading. By way of example, force distribution material 40 may comprise a compressible gel or liquid trapped in a cavity 42, such as an annular cavity, between inner layer 36 and outer layer 38. Because of the substantial compliance of outer layer 38 and its action against the gel/fluid in cavity 42, as well as the ability of inner layer 36 to move independently of outer layer 38, deformation imposed on inner layer 36 is significantly less than that of the surrounding, locally shearing subterranean material.

Figure 3:
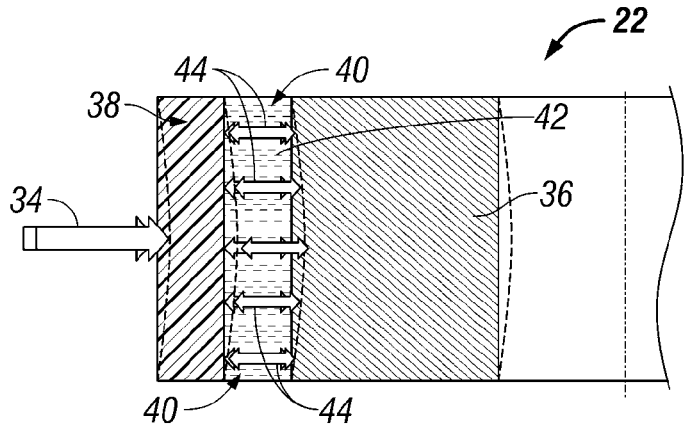
FIG. 3 is an axial, cross-sectional view of a tubular member wall section of the tubular illustrated in FIG. 2, according to an embodiment of the present invention.

As illustrated by the cross-sectional view of a tubular member wall in FIG. 3, a concentrated, external load 34 acting against tubular member 22 substantially flexes outer layer 38 locally inwardly. The flexing outer layer 38 acts against force distribution material 40 which tends to spread the concentrated load into a distributed loading along tubular member 22 and specifically along inner layer 36, as represented by arrows 44. Even though the transverse movement of the surrounding formation or other subterranean material is substantial, this movement is largely resisted by the cooperation of compliant outer layer 38 and force distribution material 40, as illustrated, and by the ability of the inner layer 36 to move freely relative to the outer layer 38. The flexing/deformation of inner layer 36 is, therefore, minimal.

Figure 4:
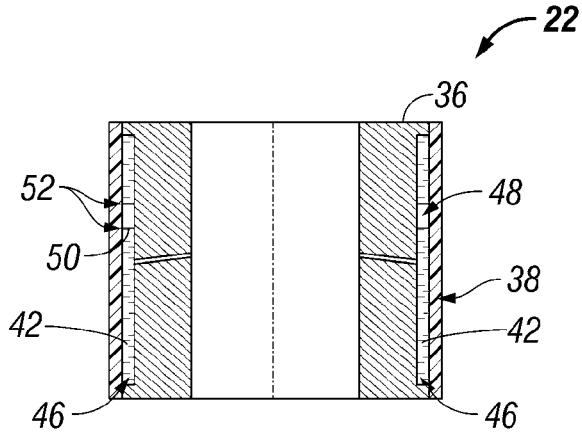
FIG. 4 is an axial, cross-sectional view of another embodiment of a tubular member, according to an alternate embodiment of the present invention.

Outer layer 38 can be affixed to inner layer 36 to enclose and seal cavity 42, as illustrated in FIG. 4. Generally, the longitudinal length of cavity 42 is less than that of inner layer 36. However, the thickness and radial position of the cavity 42 can be optimized according to the particular application. Additionally, a variety of force distribution materials 40 can be used to accommodate many types of applications and environments. For example, force distribution material 40 may comprise a compressible, non-solid material enclosed in cavity 42 in a manner able to redistribute force loads. In many applications, formation of force distribution material 40 as a compressible material avoids system over pressurization and potential failure due to, for example, temperature fluctuation during production. The extent of the compressibility can be adjusted based on various parameters, including the expected operational temperature range.

In the embodiment illustrated in FIG. 4, the compressible, non-solid material comprises a liquid or gel material 46 that may be provided with greater compressibility by introducing a gas 48 into cavity 42. In one embodiment, gas 48 is enclosed within a gas chamber 50 within the liquid/gel 46. By way of example, chamber 50 can be formed between two impermeable membranes 52 that are susceptible to aperture and/or easy deformation upon increased fluid pressure.

Figure 5:
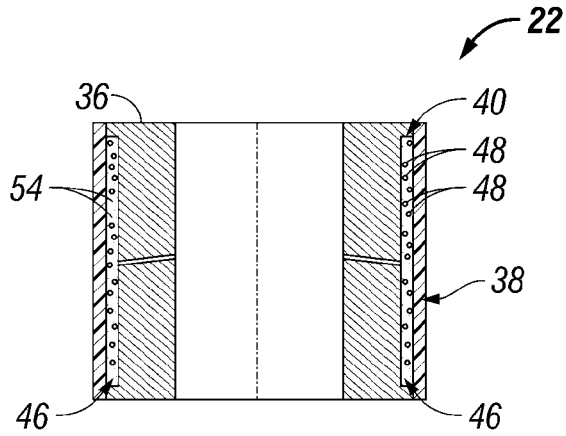
FIG. 5 is an axial, cross-sectional view of another embodiment of a tubular member, according to an alternate embodiment of the present invention.

In other applications, gas 48 can be introduced into cavity 42 by dissolving a limited amount of gas in liquid/gel 46, as illustrated in FIG. 5. Additionally, nano-particulates 54 can be introduced into the liquid/gel 46 to modify the rheological properties of the liquid phase. The rheological properties can be modified, for example, to increase the apparent viscosity, to alter the flow resistance, and to increase the maximum temperature stability. Examples of nano-particulates comprise molybdenum disulfide, graphite, and nano-sized clay particles, e.g. illite and kaolinite. In some applications, the particulates are selected so the inter-particle interactions provide the force distribution material 40 in the form of a gel. The pressure transmission response varies depending on the yield strength and the shear rate of the gel.

Force distribution material 40 also can be formulated with a Newtonian fluid. In other applications, a Newtonian fluid is combined with inert solids which can be combined in a manner that creates a slurry. Examples of suitable liquids include fluorocarbon oils/greases and silicone oils.

The compressibility can also be achieved by foaming all or a portion of the liquid or gel or by otherwise creating a force distribution material 40 as a foamed layer. Foam layers can be inorganic or organic in nature and provide flexibility while remaining stable at temperature. The gas trapped in the foam layer adds compressibility to the layer while the continuous nature of the medium ensures pressure transmission is sideways in cases where Poisson's ratio is close to 0.5.

Outer layer 38 is substantially more compliant then inner layer 36 and is positioned adjacent force distribution material 40. Thus, when a localized load is applied against outer layer 38, the compliant material of outer layer 38 flexes and cooperates with force distribution material 40 to effectively convert the concentrated stress to a manageable, distributed load along a substantial length of tubular member 22. As discussed above, outer layer 38 may be formed from a polymer material. The polymeric material can range from, for example, elastomers to flexible plastics having low moduli (see FIG. 4). In other applications, outer layer 38 may be formed as a composite layer 56, as illustrated in FIGS. 6 and 7.

Figure 6:
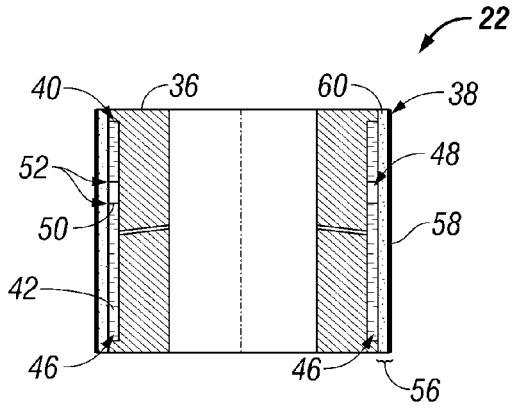
FIG. 6 is an axial, cross-sectional view of another embodiment of a tubular member, according to an alternate embodiment of the present invention.
Figure 7:
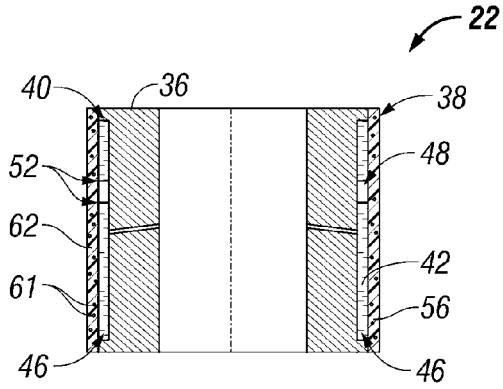
FIG. 7 is an axial, cross-sectional view of another embodiment of a tubular member, according to an alternate embodiment of the present invention.

In FIG. 6, for example, outer layer 38 comprises a flexible metal layer 58. Metal layers may be used when the metal wall thickness is sufficiently thin to allow it to be readily deformed without failing. For example, metal layer 58 may be in the form of a metallic foil combined with an inorganic layer 60, such as a clay or cement-based material. In other embodiments, composite layer 56 can be formed by the addition of filler materials 61, as illustrated in FIG. 7. Examples of filler materials 61 comprise mineral or metal-based particles and fibers. The filler materials 61 can be introduced into a variety of base materials 62 that may comprise a range of polymer and other compliant materials. For example, outer layer 38, whether formed as a uniform layer or a composite layer, may contain silicone, epoxy, polyalkylene, polyurethane, and other materials alone or in various combinations.

Figure 8:
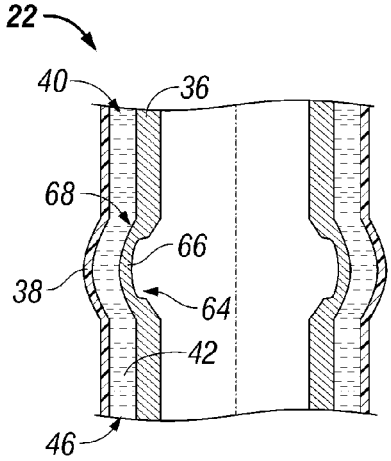
FIG. 8 is an axial, cross-sectional view of a tubular member having a controlled buckling region, according to an alternate embodiment of the present invention.
Figure 9:
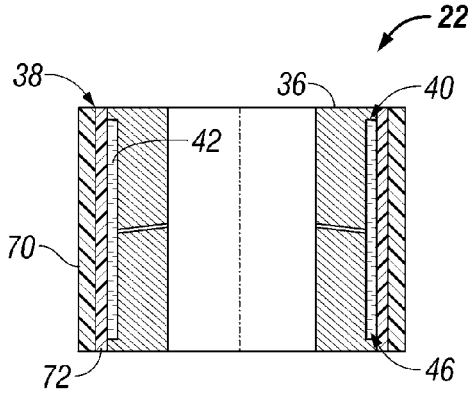
FIG. 9 is an axial, cross-sectional view of another embodiment of a tubular member, according to an alternate embodiment of the present invention.

Referring generally to FIG. 8, an alternate embodiment of tubular member 22 is illustrated in cross-section. In this embodiment, inner layer 36 is designed to allow a controlled buckling failure of tubing member 22. Buckling can be induced by formation subsidence or other subterranean movements. To accommodate this type of loading, tubular member 22 comprises a controlled buckling region 64 to ensure tubular member 22 buckles in a radially outward direction. Buckling region 64 may be created by a localized thinner wall section 66 and/or by manufacturing the tubing with an outward bulge 68 at the desired location to minimize the risk of tubular blockage. Thin wall section 66 and outward bulge 68 can be used individually or in combination as mechanisms to ensure controlled buckling in the event of a buckling failure of tubular member 22.

In another embodiment, compliant, outer layer 38 comprises a swellable material 70 located along an outer surface of a sublayer 72 that may comprise a polymer material, composite material, or other suitable material, such as those described above. By way of example, swellable material 70 may be coated onto sublayer 72. The swellable material 70 can be triggered to swell upon contact with a predetermined triggering agent, such as brine, oil, or gas. In some applications, a hybrid compliant layer 38 comprising swellable material may be utilized. Regardless, the swelling of swellable material 70 is useful in implementing effective zonal isolation in regions subject to formation sublayer movement, such as movement of shale layers.

The structure of tubular member 22 is determined according to the specific application of tubular member 22 and according to the environment in which the tubular member is employed. Additionally, the tubular member 22 can be utilized for an entire tubular device or as a portion of a larger tubular system. For example, tubular member 22 or tubular members 22 can be utilized in a subterranean pipeline or in a well application in regions particularly susceptible to localized loading. A variety of logging equipment and other types of instrumentation can be used to select appropriate sections of a well or other subterranean region in which to use force redistributing tubular members 22. In well applications, for example, tubular member 22 may form a portion of an overall casing or drill string. In other applications, a specific tubular component, such as a gravel pack packer, may be formed as tubular member 22 with an appropriate compliant layer and force distribution material.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of forming a tubular member able to mitigate localized stress, comprising:

providing a tubular layer;

surrounding at least a portion of the tubular layer with a compressible, non-solid material, the compressible, non-solid material formed with an enclosed gas chamber; and enclosing the compressible, non-solid material with a compliant layer connected to the tubular layer, wherein the compliant layer is a low modulus layer relative to the tubular layer.

2. The method as recited in claim 1, further comprising deploying the tubular member in a subterranean environment.

3. The method as recited in claim 1, further comprising forming the compressible, non-solid material with a liquid and a gas.

4. The method as recited in claim 1, further comprising forming the compressible, non-solid material with a gel.

5. The method as recited in claim 1, further comprising forming the compressible, non-solid material at least partially as a foamed material.

6. The method as recited in claim 1, further comprising forming the compressible, non-solid material with nano-particulates distributed therein.

7. The method as recited in claim 1, further comprising forming the compliant layer with polymer material.

8. The method as recited in claim 1, further comprising forming the compliant layer with a composite material.

9. The method as recited in claim 1, further comprising forming the compliant layer from a metallic foil combined with an inorganic layer.

10. A tubular member comprising:

a tubular layer;

a compressible, non-solid material surrounding at least a portion of the tubular layer, the compressible, non-solid material comprising an enclosed gas chamber; and a compliant layer affixed to the tubular layer and enclosing in a cavity the compressible, non-solid material, wherein the compliant layer is a low modulus layer relative to the tubular layer.

11. The tubular member as recited in claim 10, wherein the compressible, non-solid material comprises a liquid and a gas.

12. The tubular member as recited in claim 10, wherein the compressible, non-solid material is a gel.

13. The tubular member as recited in claim 10, wherein the compressible, non-solid material is at least partially a foamed material.

14. The tubular member as recited in claim 10, wherein the compressible, non-solid material has nano-particulates distributed therein.

15. The tubular member as recited in claim 10, wherein the compliant layer is formed of a polymer material.

16. The tubular member as recited in claim 10, wherein the compliant layer is formed of a composite material.

17. The tubular member as recited in claim 10, wherein the compliant layer is formed from a metallic foil combined with an inorganic layer.

* * * * *